US005998077A

United States Patent [19]

Odell et al.

[11] Patent Number: 5,998,077

[45] Date of Patent: Dec. 7, 1999

[54] COATED CARRIER

[75] Inventors: Peter G. Odell, Mississauga, Canada; Scott M. Silence, Fairport; K. Derek Henderson, Rochester, both of N.Y.

[73] Assignee: Xerox Corporation, Stamford, Conn.

[21] Appl. No.: 09/106,340

[22] Filed: Jun. 29, 1998

[51] Int. Cl.[6] ..... G03G 9/113

[52] U.S. Cl. ..... 430/106.6; 430/108

[58] Field of Search ..... 430/108, 106.6

[56] References Cited

U.S. PATENT DOCUMENTS

| | | | |
|---|---|---|---|
| 3,590,000 | 6/1971 | Palermiti et al. | 252/62.1 |
| 4,233,387 | 11/1980 | Mammino et al. | 430/137 |
| 4,264,697 | 4/1981 | Perez et al. | 430/107 |
| 4,265,990 | 5/1981 | Stolka et al. | 430/59 |
| 4,338,390 | 7/1982 | Lu | 430/106 |
| 4,546,172 | 10/1985 | Kohyama et al. | 528/491 |
| 4,560,635 | 12/1985 | Hoffend et al. | 430/106.6 |
| 4,563,408 | 1/1986 | Lin et al. | 430/59 |
| 4,584,253 | 4/1986 | Lin et al. | 430/59 |
| 4,585,884 | 4/1986 | Lin et al. | 556/413 |
| 4,810,611 | 3/1989 | Ziolo et al. | 430/106.6 |
| 4,888,411 | 12/1989 | Shannon et al. | 528/199 |
| 4,921,975 | 5/1990 | Shannon et al. | 549/228 |
| 4,935,326 | 6/1990 | Creatura et al. | 430/108 |
| 4,937,166 | 6/1990 | Creatura et al. | 430/108 |
| 4,940,779 | 7/1990 | Ashida et al. | 528/495 |
| 4,972,039 | 11/1990 | Shannon et al. | 528/371 |
| 5,182,363 | 1/1993 | Asoh et al. | 528/499 |
| 5,196,507 | 3/1993 | Totani et al. | 528/491 |
| 5,227,460 | 7/1993 | Mahabadi et al. | 528/272 |
| 5,352,556 | 10/1994 | Mahabadi et al. | 430/109 |
| 5,376,494 | 12/1994 | Mahabadi et al. | 430/137 |
| 5,395,723 | 3/1995 | Mahabadi et al. | 430/109 |
| 5,401,602 | 3/1995 | Mahabadi et al. | 430/137 |
| 5,565,291 | 10/1996 | Mayama et al. | 430/108 |
| 5,663,277 | 9/1997 | Isshiki et al. | 528/196 |
| 5,688,626 | 11/1997 | Patel et al. | 430/137 |
| 5,719,002 | 2/1998 | Ciccarelli et al. | 430/137 |

FOREIGN PATENT DOCUMENTS

| | | |
|---|---|---|
| 2-239256 | 9/1990 | Japan . |

*Primary Examiner*—Christopher D. Rodee
*Attorney, Agent, or Firm*—E. O. Palazzo

[57] ABSTRACT

A carrier composition comprised of a core and thereover a linear polycarbonate polymer obtained from the curing of a cyclic polycarbonate oligomer with an $M_w$ of about 5,000 to about 300,000, and an $M_n$ of about 2,000 to about 150,000.

19 Claims, No Drawings

COATED CARRIER

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to compositions, especially carrier compositions comprised of a core and thereover certain polycarbonates, such as polycarbonate polymers formed by the thermal curing of cyclic polycarbonate oligomers and related oligomers with polar groups of, for example, tertiary amines or perfluorinated moieties incorporated to, for example, provide excellent acceptable charging characteristics for xerographic image development systems.

Advantages of the carriers of the present invention include in embodiments carrier coatings which are very robust, that is, they are substantially resistant to polymer fracture and subsequent chipping and delamination of the polymer from the core surface in, for example, high energy xerographic environments, that is, in which the energy imparted to the toner is about 0.5 W-hr per pound or higher, and which carriers additionally display a tribo charge of a positive value, for example from about a minus 35 to about a minus 40 microcoulombs per gram and a corresponding high negative tribo charge to the toner, excellent admix, for example, from about 1 to about 30 seconds as determined in a charge spectrograph, and the like. More specifically, the toner tribo can be, it is believed, from about a minus 5 to about a minus 50 microcoulombs per gram, from about a minus 25 to about a minus 45 microcoulombs per gram, or from about a minus 35 to about a minus 40 microcoulombs per gram, and more specifically, preferably, for example, about 15 to about 25, with corresponding positive tribo charges for the carrier. The tribo charges can be determined by a number of known methods, such as the use of a Faraday Cage.

Other advantages of the present invention include increased resistance of the carrier to mechanical aging in a xerographic environment and a decreased sensitivity of the carrier triboelectric value to the relative humidity of the environment. With respect to high toner tribo charge of a negative value, this property is important to xerographic, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

The carrier particles of the present invention can be selected for a number of different xerographic copiers and printers, such as high speed color xerographic copies, printers, digital copiers, and more specifically, wherein colored copies with excellent and substantially no background deposits are achievable in copiers, printers, digital copiers, and the combination of xerographic copiers and digital systems. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and dispersant component applied to the carrier core and the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith.

Carrier particles for use in the development of electrostatic latent images are described in many patents including, for example, U.S. Pat. No. 3,590,000. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where part of, or the entire coating may separate from the carrier core in the form of chips or flakes, and fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low tribo as compared to the high tribo carriers of the present invention.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There are illustrated in U.S. Pat. Nos. 4,937,166 and 4,935,326, the disclosures of which are totally incorporated herein by reference, carriers containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such as halides including copper iodide, copper fluoride, and mixtures thereof.

With further reference to the prior art, carriers obtained by applying insulating resinous coatings to porous metallic carrier cores using solution coating techniques are undesirable from many viewpoints. For example, the coating is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention minimizes these disadvantages, and further enable developers that are capable of generating high triboelectric charging values with finely divided toner particles; and also wherein the carrier particles in embodiments are of a substantially constant conductivity.

When resin coated carrier particles are prepared by powder coating process the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and high carrier triboelectric charging value of from a positive triboelectric charge of about 20 to a positive triboelectric charge of about 50, and for example, from a positive about 25 to a positive about 45, and more specifically, about 20 microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles and contained therein conductive particles of, for example, carbon black.

Other U.S. Patents that may be of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; 4,434,220 and 5,240,226, the disclosures of each of these patents being totally incorporated herein by reference.

SUMMARY OF THE INVENTION

It is a feature of the present invention to provide toner and developer compositions with carrier particles containing a polymer coating.

In another feature of the present invention there are provided dry coating processes for generating carrier particles of substantially constant conductivity parameters.

In yet another feature of the present invention there are provided dry coating processes for generating carrier particles of substantially constant conductivity parameters, and high triboelectric charging values.

In yet a further feature of the present invention there are provided carrier particles with high tribo values of at least about 25 microcoulombs per gram of toner, and wherein the carrier includes thereover a linear polycarbonate generated from a cyclic oligomer polycarbonate, or a coating of two polymers of polycarbonate and, for example, polymethylmethacrylate, or poly(urethane), and wherein the coating may contain therein a conductive component of, for example, carbon black.

The present invention relates to developer compositions comprised of toner particles, and carrier particles prepared, for example, by a powder coating process, and wherein the carrier particles are comprised of a core with certain coatings thereover. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of certain polymers, and which polymer may optionally contain dispersed therein carbon black or a similar conductive component, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

More specifically, the carriers of the present invention are comprised of a core, and thereover a polymer formed by curing a cyclic polycarbonate oligomer, wherein the oligomer is prepared according to the method disclosed in Brunelle et al., *Jour. Amer. Chem. Soc.,* 1990, 112, 2399 to 2402, the disclosure of which is totally incorporated herein by reference, and of the following formula, where n is a suitable number, such as a number, or integer of from about 2 to about 20 and predominately from about 2 to about 12,

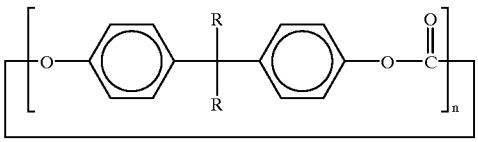

and R may be a suitable group, such as preferably an aliphatic group, such as alkyl with, for example, from 1 to about 25 carbon atoms, methyl, ethyl, perfluoromethyl, or wherein R—C—R can be replaced by a cyclohexylidene group.

Aspects of the present invention relate to the carrier particles comprised of a core with a coating thereover of cyclic polycarbonate oligomers which when cured with heating provide a high $M_w$ of, for example, between about 30,000 and 300,000 Daltons and $M_n$ of between, for example, about 15,000 and about 150,000, of linear polycarbonates, and wherein aryl amines may be incorporated into the cyclic oligomer to provide, upon curing, a linear polycarbonate with amine moieties in the backbone. Bisphenol amines from, for example, about 5 mole percent to about 40 mole percent, such as dihydroxy-N,N,N',N'-tetraphenyl-[1,1'-biphenyl]-4,4'-diamine, or 4,4'-hexafluoroisopropylidene bisphenol that impart a range of charging properties to the coating polymers may be included in the cyclic polycarbonate to, for example, increase the positive charge imparted to the carrier and to decrease the positive charge or impart a negative charge to the carrier with respect to halogenated moieties, and more specifically, fluorinated moieties. The addition of the amine to the carrier coating can render the toner charge more negatively, for instance at a 5 mole percent of amine, the negative charge on a toner can be increased to −18.3 microcoulombs per gram from −14.0 microcoulombs per gram. Also, the incorporation of a high concentration of 4,4'-hexafluoroisopropylidene bisphenol monomer, that is, greater than about 80 percent, and more specifically, from about 80 to about 95 percent, is believed to provide about 30 percent fluorine exposure on the surface of the carrier bead. Carriers with polymer coatings of comparable fluorine surface exposures, for instance polymers composed of polyvinylidene fluoride (KYNAR 301F®, available from Elf Atochem), in which the surface fluorine concentrations are measured to be about 35 to 40 percent by standard analytical techniques, such as x-ray photoelectron spectroscopy, are known to impart triboelectric values to a toner of greater than a positive 60 microcoulombs per gram. Therefore, triboelectric levels of at least positive 50 microcoulombs per gram are expected with incorporation of fluorinated species, such as 4,4'-hexafluoroisopropylidene bisphenol, into the polymer backbone.

Curing can optionally be accomplished in the presence of colorants like carbon black and which enables the modification of the conductivity characteristics of the coated carrier, from about $10^{-14}$ $ohms^{-1}$-$cm^{-1}$ without carbon black to about $10^{-8}$ $ohms^{-1}$-$cm^{-1}$ with about 20 percent by weight of carbon black. Moreover, the oligomer polycarbonate can be crosslinked, for example, from about 0.5 to about 3 percent, and wherein there may be selected for the crosslinking agent tetraphenol during curing by incorporating tetraphenols into the cyclic oligomer as described in U.S. Pat. No. 4,888,411, the disclosure of which is totally incorporated herein by reference. The polymer coating may contain a conductive component, such as carbon black, and which conductive component is preferably dispersed in the polymer coating. With the conductive component there are enabled carriers with increased developer triboelectric response at relative humidities of from about 20 to about 90 percent, and improved image quality performance, excellent high conductivity ranges of from about $10^{-10}$ to about $10^{-7}$ $(ohm\text{-}cm)^{-1}$, and the like. An important advantage associated with the carriers of the present invention with the polymer coatings thereover include a mechanically robust layer that adheres well to the core and is not readily removed from the core in the abrasive environment of the developer housing, such as a Xerox Corporation 5090 developer housing.

The cyclic oligomers selected are of particular utility since they form a low viscosity melt prior to curing to a high molecular weight. The low viscosity of, for example, about 10 poise at 250° C. provides excellent contact with, or wetting of the carrier bead surface. The high viscosity of high molecular weight polycarbonates of, for example, about $10^6$ poise at 250° C. can slow or prevent such wetting phenomena which are important to achieve good adhesion. Furthermore, the cyclic oligomers are readily isolated as a powder. This is not believed to be the situation for high molecular weight polycarbonates where agglomeration of the sticky polymer-solvent mixture results and is to be avoided. For instance in U.S. Pat. No. 4,546,172 evaporation of methylene chloride and subsequently water is used to isolate the polycarbonate. In U.S. Pat. Nos. 4,940,779 and 5,182,363 a similar approach is applied with the inclusion of a poor solvent for the polycarbonate. In U.S. Pat. No. 5,196,507 an antisolvent is added along with seed particles of polycarbonate and combined with devolatilization and grinding. In U.S. Pat. No. 5,663,277 careful control over solvent-water ratios and temperature in an extruder is employed to produce polycarbonate particles. These techniques are complex and cumbersome and provide particles with inferior rheological properties for powder coating. More specifically, melt rheologies which are too high, about $10^6$ poise at 250° C., are not as suitable for the powder coating carrier process. For comparison, high molecular weight polymethylmethacrylate (Mw of about 400,000), which is widely used in small particle form (1 micron or below) as a polymer in the carrier powder coating process, has a significantly lower melt viscosity, about $10^4$ poise at 250° C.

Embodiments of the present invention include a composition comprised of a core, and thereover, a linear polycarbonate in an amount of from about 0.05 to about 3 weight percent of the total carrier composition, and which may optionally contain a conductive component such as a metal oxide, or a pigment, like carbon black, wherein the conductive component is selected in an amount of from about 10 to about 75, or from about 20 to about 60 weight percent based on the sum of the polycarbonate polymer and conductive component; a carrier with two polymers thereover, wherein the first polymer is a linear polycarbonate and wherein the conductive component for the first or second polymer is a metal oxide, or a pigment, like preferably carbon black, wherein the conductive component is carbon black selected in an amount of from about 10 to about 50 weight percent; wherein the second polymer is as illustrated herein, that is for example, a fluorocarbon, polymethylmethacrylate (PMMA), a thermosetting polymer, such as a thermosetting polyurethane, a polyester, a styrene based polymer, or a nitrogen-containing copolymer, and wherein the first polymer is selected in an amount of from about 1 to about 100, or from about 10 to about 75 weight percent, based on the total weights of all polymers and conductive components and the second polymer is selected in an amount of from about 99 to about 0, or from about 90 to about 25 weight percent; wherein the carrier core is a metal, a ferrite, a metal oxide, and the like, such as known carrier cores.

In aspects thereof, the present invention relates to carrier composition comprised of a core and thereover a linear polycarbonate polymer obtained from the curing of a cyclic polycarbonate oligomer with an $M_w$ of about 5,000 to about 300,000, and an $M_n$ of about 2,000 to about 150,000; a carrier wherein said cyclic is of a ring size of about 2 to about 20 members; a carrier wherein said oligomer is

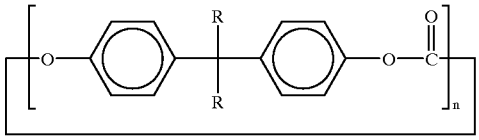

where n is an integer of from 2 to about 20, and R is an aliphatic group; a composition wherein said oligomer is derived from 4,4'-isopropylidene bisphenol, 4,4'-cyclohexylidene bisphenol, dihydroxy-N,N,N',N'-tetraphenyl-[1,1'-biphenyl]-4,4'-diamine, or 4,4'-hexafluoroisopropylidene bisphenol, and said polymer is cyclo-poly(4,4'-isopropylidene bisphenol) carbonate, cyclo-poly(4,4'-isopropylidene bisphenol-co-dihydroxy-N,N,N',N'-tetraphenyl-[1,1'-biphenyl]-4,4'-diamine) carbonate, cyclo-poly(4,4'-isopropylidene bisphenol-co-4,4'-hexafluoroiso propylidene bisphenol) carbonate, or cyclo-poly(4,4'-cyclohexylidene bisphenol) carbonate; a composition wherein said linear polymer carrier coating is poly(4,4'-isopropylidene bisphenol) carbonate, poly(4,4'-cyclohexylidene bisphenol) carbonate, poly(4,4'-isopropylidene bisphenol-co-dihydroxy-N,N,N',N'-tetraphenyl-[1,1'-biphenyl]-4,4'-diamine) carbonate, poly(4,4'-isopropylidene bisphenol-co-4,4'-hexafluoroisopropylidene bisphenol) carbonate, or poly(4,4'-cyclohexylidenebisphenol-co-dihydroxy-N,N,N',N'-tetraphenyl-[1,1'-biphenyl]-4,4'-diamine) carbonate, with, for example, an $M_w$ of about 5,000 to about 300,000, or about 50,000 to about 150,000, and $M_n$ of about 2,000 to about 150,000, or about 25,000 to about 100,000; a carrier composition wherein the curing of the coating is accomplished by heating; a composition wherein the heating is a temperature of about 200° C. to about 300° C.; a carrier wherein the oligomer coating amount is about 0.1 to about 20.0 weight percent; a carrier wherein the linear polymer coating is of an $M_w$ of from about 5,000 to about 300,000, and of an $M_n$ of from about 2,000 to about 150,000; a carrier wherein the polymer coating weight thereof is from about 0.1 to about 20 weight percent; a carrier wherein the polymer coating weight is from about 1 to about 3 weight percent; a carrier wherein the polymer contains a conductive component; a carrier wherein the conductive component is a metal oxide, or is carbon black; a carrier wherein said conductive component is carbon black selected in an amount of from about 10 to about 60 weight percent; a carrier wherein said core is a metal, a metal oxide, or a ferrite; a carrier with a triboelectric charge of from about a positive 5 to about a positive 50 microcoulombs per gram, and a conductivity of about $10^{-14}$ to about $10^{-6}$ $(\text{ohm-cm})^{-1}$; a carrier with a triboelectric charge of from about a positive 25 to about a positive 45 microcoulombs per gram; a developer wherein the toner is comprised of thermoplastic resin and colorant; a developer wherein the colorant is a pigment and the resin is a styrene polymer, or a polyester; a carrier further containing a second polymer coating; a carrier wherein the second polymer coating is comprised of styrene acrylate, styrene methacrylate, or a fluoropolymer; a carrier wherein the second polymer coating is comprised of a polyurethane, and which polyurethane optionally contains dispersed therein conductive components; a carrier wherein the second coating is comprised of a polyurethane/polyester with carbon black dispersed therein; a process for the preparation of a carrier which comprises the coating of a carrier core with a polycarbonate generated from the curing of an oligomeric cyclic polycarbonate; and a carrier comprised of a core and thereover a linear polycarbonate polymer obtained from a cyclic polycarbonate.

Specific examples of bisphenols forming the units of the cyclic polycarbonate oligomers are, for example, 4,4'-isopropylidene bisphenol, 4,4'-cyclohexylidene bisphenol, dihydroxy-N,N,N',N'-tetraphenyl-[1,1'-biphenyl]-4,4'-diamine, 4,4'-hexafluoroisopropylidene bisphenol, and which oligomers are selected in various suitable amounts, such as for example, about 0.05 to about 3.0 weight percent based on weight of the core. Upon curing, for example heating at about 200° C. to about 300° C., the oligomer converts into a linear polycarbonate with, for example, an $M_w$ of about 5,000 to about 300,000, and an $M_n$ of about 2,000 to about 150,000 and which $M_w$ and $M_n$ are determined by Gel Permeation Chromatography against polystyrene standards. Polycarbonates formed are poly(4,4'-isopropylidene bisphenol) carbonate, poly(4,4'-cyclohexylidene bisphenol) carbonate, poly(4,4'-isopropylidenebisphenol-co-dihydroxy-N,N,N',N'-tetraphenyl-[1,1'-biphenyl]-4,4'-diamine) carbonate, poly(4,4'-isopropylidenebisphenol-co-4,4'-hexafluoro-isopropylidenebisphenol) carbonate, poly(4,4'-cyclohexylidenebisphenol-co-dihydroxy-N,N,N',N'-tetraphenyl-[1,1'-biphenyl]-4,4'-diamine) carbonate.

Various monomers can be incorporated into the reaction mixtures used to form the cyclic oligomers and to generate crosslinking during the curing step. Examples of such monomers and processes for incorporating them into cyclic oligomers are disclosed, for example, in U.S. Pat. Nos. 4,921,975; 4,888,41 1; and 4,972,039; the disclosures of which are incorporated by reference herein in their entirety. Monomers include tetraphenols such as, for example, bis(2,4-dihydroxy-3-methylphenyl) methane; 2,2',4,4'-tetrahydroxybiphenol; 2,2',4,4'-tetrahydroxybenzophenone; and trisphenols such as 4-{4-[1,1-bis(4-hydroxyphenyl) ethyl]-á,á-dimethyl benzyl}; and 4-1,3,5-tris(4-hydroxy-á,á-dimethylbenzyl)-benzene. The crosslinker may be selected in amounts from about 1 to about 10 mole percent of the total concentration of monomer used in the cyclic synthesis. Crosslinked polymers can display excellent stability to physical stress as described in Odian's Principles of Polymerization, John Wiley & Sons, New York.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics; and also for example, a suitable core surface morphology to permit high electrical conductivity of the developer comprising the carrier and a suitable toner. Examples of carrier cores that can be selected include iron, steel, ferrites such as Sr(strontium)-ferrite, Ba-ferrite, Cu/Zn-ferrite, and Ni/Zn-ferrite, magnetites, nickel, mixtures thereof, and the like. Preferred carrier cores include ferrites, and sponge iron, or steel grit with an average particle size diameter of from between about 30 microns to about 200 microns.

The polymer coating preferably has dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

The process for incorporating the polymer onto a carrier core can be sequential, a process in which one of the two or more polymers is fused to the surface in a first step and the second polymer is fused to the surface in a subsequent fusing operation. Alternatively, the process for incorporation can comprise a single fusing.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)] chromate(1-), ammonium sodium and hydrogen (TRH), cetyl pyridinium chloride (CPC), FANAL PINK® D4830, and the like, including those as specifically illustrated herein, and other effective known charge agents or additives. The charge additives are selected in various effective amounts, such as from about 0.05 to about 15, and from about 0.1 to about 3 weight percent, based on the sum of the weights of all polymer, conductive additive, and charge additive components.

Examples of second polymers selected can include known polymers, such as polymonoalkyl or dialkyl methacrylates or acrylates, polyurethanes, fluorocarbon polymers such as polyvinylidenefluoride, polyvinylfluoride, polypentafluorostyrene, polyethylene, polyethylene-co-vinylacetate, polyvinylidenefluoride-co-tetrafluoroethylene, and the like. Other known related polymers not specifically mentioned herein may also be selected, such as those illustrated in the U.S. Pat. Nos. 4,937,166 and 4,935,326 patents mentioned herein.

Another second polymer is comprised of a thermosetting polymer, and more specifically, a poly(urethane) thermosetting resin which contains, for example, from about 75 to about 95, and preferably about 80 percent by weight of a polyester polymer, which, when combined with an appropriate crosslinking agent, such as isopherone diisocyannate, and initiator, such as dibutyl tin dilaurate, forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first polymer, generally prior to mixing with the core, and which when fused forms a uniform coating of the first and second polymers on the carrier surface. The second polymer is present in an amount of from about 0 percent to about 99 percent by weight, based on the total weight of the first and second polymers and the conductive component in the first polymer.

Various effective suitable processes can be selected to apply the polymer, or a mixture, for example from 2 to about 5, and preferably two, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. Nos. 5,376,494; 5,395,723; 5,401,602; 5,227,460 and 5,352,556, the disclosures of which are totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments, dyes, or mixtures thereof, and preferably pigments can be selected as the colorant for the toner particles including, for example, carbon black, nigrosine dye, lamp black, iron oxides, magnetites, and mixtures thereof. The colorant, which is preferably carbon black, should be present in a sufficient amount to render the toner composition highly colored. Thus, the colorant is present in amounts of, for example, from about 1 percent by weight to about 20, and preferably from about 5 to about 12 percent by weight, based on the total weight of the toner components, however, lesser or greater amounts of pigment may be selected. Colorants include dyes, pigments, mixtures thereof, mixtures of dyes, mixtures of pigments, and the like, such as carbon black, cyan, magenta, yellow, green, red, and the like, pigments and dyes, reference U.S. Pat. Nos. 5,688,626 and 5,719,002, the disclosure of which is totally incorporated herein by reference.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

Also, there may be selected colored toner compositions comprised of toner resin particles, carrier particles and as colorants, such as pigments, dyes, and mixtures thereof, and preferably magenta, cyan and/or yellow particles, and mixtures thereof. More specifically, illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyans include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, can be selected. These colorants, especially pigments, are generally present in the toner composition in an amount of from about 1 weight percent to about 15, and for example, from about 2 to about 12 weight percent based on the weight of the toner components of binder and pigment.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, and the like. Other methods include those well known in the art such as spray drying, melt dispersion, dispersion polymerization and suspension polymerization. In one dispersion polymerization method, a solvent dispersion of the resin particles and the pigment particles is spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules, there can be selected the aryl diamines disclosed in the aforementioned patents, such as the '990 patent. These layered members are conventionally charged negatively thus requiring a positively charged toner.

Images, especially colored images obtained with this developer composition, possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being supplied to further define the present invention, it being noted that these Examples are intended to illustrate and not limit the scope of the present invention. Parts and percentages are by weight unless otherwise indicated.

EXAMPLE I

Synthesis of Bisphenol A Cyclic Oligomers

The reaction was conducted in a one liter Morton flask equipped with a mechanical stirrer, a condenser, septum, addition funnel and heating mantle. To this flask were added 200 milliliters of methylene chloride, 7 milliliters of deionized water, 3 milliliters 9.75 Molar NaOH solution, and 2.4 milliliters of triethyl amine. Stirring and gentle reflux by heating at the reflux temperature of methylene chloride (40° C.) was initiated. Bisphenol A bischloroformate, from VanDeMark Chemical Company of Lockport, N.Y., previously recrystallized from hexane, about 70.5 Grams, were dissolved into 200 milliliters of methylene chloride and added to the flask by means of a peristaltic pump over the course of forty minutes. Concurrently, about 59 milliliters of about 9.75 Molar sodium hydroxide solution were added by means of the addition funnel and about 2.4 milliliters of triethyl amine were added by means of a syringe pump. After forty minutes, the reaction was terminated by the addition of 200 milliliters of 1M HCl solution. The reaction mixture was transferred to a separatory funnel where the organic and aqueous layers separated and the organic layer was washed with deionized water (3 times) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 grams of a mixture of different ring (2 to 20 membered rings) sizes of cyclic oligomers of 4,4'-isopropylidene bisphenol carbonate. Confirmation of the product structure was determined by GPC and NMR.

EXAMPLE II

Dihydroxy-N,N,N',N'-tetraphenyl-[1,1'-biphenyl]-4,4'-diamine was incorporated at 5 and 30 mol percent using the techniques and reagents of Example I except that 36.2 grams of bisphenol A bischloroformate and 2.97 grams of dihydroxy-N,N,N',N'-tetraphenyl-[1,1'-biphenyl]-4,4'-diamine were used to produce 5 mol percent of diamine in the oligomer, while the 30 mol percent oligomer was produced with 27.4 grams and 18.2 grams of the respective reagents.

EXAMPLE III

Ten grams of the cyclic oligomer prepared in Example I and 0.0258 gram of tetrabutylammonium tetraphenylborate were dissolved in a mixture of about 70 parts methylene chloride, 20 parts THF, and 10 parts hexane, and then the solvent was allowed to evaporate. A fine white powder of cyclic oligomer of the formula

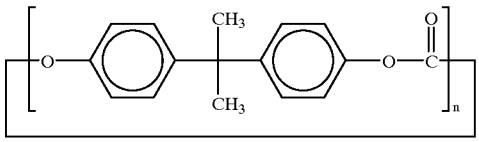

containing about 0.26 percent of the catalyst, tetrabutylammonium tetraphenylborate, was recovered, and wherein n was estimated to vary predominately from 2 to about 12 based on the multiple peaks in the GPC chromatogram.

EXAMPLE IV

Carrier Preparation

In the first step of the carrier coating process, 10 grams of the bisphenol A cyclic oligomer/tetrabutylammonium tetraphenylborate mixture prepared in Example III and 990 grams of a 100 micron volume median diameter spherical steel core (obtained from Nuclear Metals) were mixed. The mixing was accomplished in a V-Cone blender with the following process conditions: blender speed of 23.5 rotations per minute and a blend time of 30 minutes. There resulted uniformly distributed and electrostatically attached oligomeric material on the core as determined by visual observation. In the second step, the resulting carrier particles were inserted into a rotating tube furnace for a period of 30 minutes. This furnace was maintained at a temperature of 400° F. (200° C.) thereby causing the bisphenol A cyclic oligomer/tetrabutylammonium tetraphenylborate mixture to melt and flow over the core surface and subsequently undergo the polymerization reaction described above yielding poly(4,4'-isopropylidene bisphenol) carbonate polymer fused to the surface of the core. The product from the kiln was screened through an 84 TBC (Tensile Bolt Cloth) mesh screen to remove any large agglomerates. The final product was comprised of a carrier core with a total of 1 percent bisphenol A polycarbonate polymer by weight on the surface. The carrier was insulative (conductivity $<1\times10^{-14}$ $(\text{ohm-cm})^{-1}$), indicating reasonably complete polymer coverage of the core.

Standard surface analytical techniques of scanning electron microscopy and x-ray photoelectron spectroscopy were preformed on the surface of this carrier and indicate that the surface of the metal core is completely covered by the polymer, and that the polymer coating was fairly smooth and formed a flat and generally featureless film on the surface of the core.

EXAMPLE V

Developer Preparation

A developer composition was then prepared by mixing 200 grams of the above prepared Example IV carrier with 10 grams of a 9 micron volume median diameter (volume average diameter) toner composition comprised of a 30 percent (by weight) gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer. Thereafter, the triboelectric charge on the carrier particles was determined by the known Faraday Cage process. At short mixing times, that is between 1 and 5 minutes of developer agitation time, the average triboelectric value was determined to be 7.9 microcoulombs per gram of toner; at longer mixing times, that is between 20 and 60 minutes of developer agitation time, the average triboelectric value was determined to be 6.6 microcoulombs per gram of toner. This gave a ratio of the triboelectric value at long mixing times to that of short mixing times of 0.84. The ideal value would be 1.

For comparison, a carrier was coated with a conventional thermoplastic poly(methylmethacrylate) polymer by the identical process as that of Example IV and combined with a toner in a manner identical to that of the developer preparation described above. Thereafter, the triboelectric charge on the carrier particles was determined by the known Faraday Cage process. At short mixing times, that is between 1 and 5 minutes of developer agitation time, the triboelectric value was determined to be 16.6 microcoulombs per gram of toner; at longer mixing times, that is between 20 and 60 minutes of developer agitation time, the triboelectric value was determined to be 10.1 microcoulombs per gram of toner. This provided a ratio of the triboelectric value at long mixing times to that of short mixing times of 0.61, a substantially lower value than that of 0.84 for the polycarbonate coated carrier, indicating increased mechanical integrity of the polycarbonate carrier coating with respect to a conventional poly (methylmethacrylate) carrier coating.

EXAMPLE VI

To assess the impact of the inclusion of the diamine in Example II, the acetone insoluble polymer byproduct of the synthesis of the 5 mol percent diamine material, which is expected to share the same composition as the cyclic oligomer, was solution coated onto a 100 micron core. The solution coating was accomplished using about 17 grams of 10 weight percent polymer in methylene chloride which was added to about 250 grams of 100 micron core that had been heated to about 70° C. The carrier core and polymer mixture were stirred with a metal spatula until the solvent evaporated over the course of about fifteen minutes. The coated carrier was then passed through a 450 micron mesh sieve. As a control, a linear polymer of poly(4,4'-isopropylidenebiphenol) carbonate of $M_w$ of about 50,000 was also solution coated onto the same type of core. The control provided a toner charge of 14.0 microcoulombs per gram of toner, while the carrier coated with the diamine containing polymer gave a toner charge of 18.3 microcoulombs per gram of toner. This indicated an increase in the triboelectric charging value of about 4.3 microcoulombs per gram of toner with the inclusion of 5 mol percent diamine in the polycarbonate matrix. A linear extrapolation of this data implied that a triboelectic charge of about 40 microcoulombs per gram of toner can be achieved with the inclusion of about 30 mol percent of the diamine in the polycarbonate matrix and that a triboelectic charge of about 50 microcoulombs per gram of toner can be achieved with the inclusion of about 40 mol percent of the diamine in the polycarbonate matrix.

Other embodiments and modifications of the present invention may occur to those of ordinary skill in the art subsequent to a review of the present application and the information presented herein; these embodiments modifications, and equivalents, or substantial equivalents thereof, are also included within the scope of the present invention.

What is claimed is:

1. A carrier comprised of a core and thereover a first polymer coating comprising a linear polycarbonate polymer obtained from the curing of a cyclic polycarbonate oligomer with an $M_w$ of about 5,000 to about 300,000, and an $M_n$ of about 2,000 to about 150,000, and a second polymer coating, and wherein said second coating is comprised of a polyurethane, and which polyurethane optionally contains dispersed therein conductive components.

2. A carrier in accordance with claim 1 wherein said cyclic is of a ring size of about 2 to about 20 members.

3. A carrier in accordance with claim 1 wherein said oligomer is

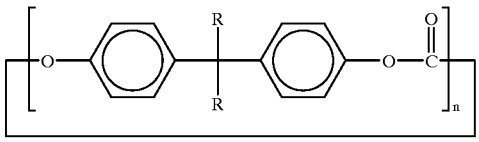

where n is an integer of from about 2 to about 20, and R is an aliphatic group.

4. A carrier in accordance with claim 3 wherein R is methyl, ethyl, or perfluoromethyl.

5. A carrier in accordance with claim 1 wherein said oligomer is derived from 4,4'-isopropylidene bisphenol, 4,4'-cyclohexylidene bisphenol, dihydroxy-N,N,N',N'-tetraphenyl-[1,1'-biphenyl]-4,4'-diamine, or 4,4'-hexafluoroisopropylidene bisphenol, and said oligomer is cyclo-poly(4,4'-isopropylidene bisphenol) carbonate, cyclo-poly(4,4'-isopropylidene bisphenol-co-dihydroxy-N,N,N',N'-tetraphenyl-[1,1'-biphenyl]-4,4'-diamine) carbonate, cyclo-poly(4,4'-isopropylidene bisphenol-co-4,4'-hexafluoroiso propylidene bisphenol) carbonate, or cyclo-poly(4,4'-cyclohexylidene bisphenol) carbonate.

6. A carrier in accordance with claim 1 wherein the curing is accomplished by heating.

7. A carrier in accordance with claim 6 wherein the heating is a temperature of about 200° C. to about 300° C.

8. A carrier in accordance with claim 1 wherein the first polymer coating weight thereof is from about 0.1 to about 20 weight percent.

9. A carrier in accordance with claim 1 wherein the first polymer coating weight is from about 1 to about 3 weight percent.

10. A carrier in accordance with claim 1 wherein the first polymer coating contains a conductive component.

11. A carrier in accordance with claim 10 wherein the conductive component is a metal oxide, or is carbon black.

12. A carrier in accordance with claim 10 wherein said conductive component is carbon black selected in an amount of from about 10 to about 60 weight percent.

13. A carrier in accordance with claim 1 wherein said core is a metal, a metal oxide, or a ferrite.

14. A carrier in accordance with claim 1 with a triboelectric charge of from about a positive 5 to about a positive 50 microcoulombs per gram, and a conductivity of about $10^{-14}$ to about $10^{-6}$ $(\text{ohm-cm})^{-1}$.

15. A carrier in accordance with claim 1 with a triboelectric charge of from about a positive 25 to about a positive 45 microcoulombs per gram.

16. A developer comprised of the carrier of claim 1 and toner.

17. A developer in accordance with claim 16 wherein the toner is comprised of thermoplastic resin and colorant.

18. A developer in accordance with claim 16 wherein the colorant is a pigment and the resin is a styrene polymer, or a polyester.

19. A carrier comprised of a core and thereover a first polymer coating comprising a linear polycarbonate polymer obtained from the curing of a cyclic polycarbonate oligomer with an $M_w$ of about 5,000 to about 300,000, and an $M_n$ of about 2,000 to about 150,000, and a second polymer coating, and wherein the second coating is comprised of a polyurethane/polyester with carbon black dispersed therein.

* * * * *